United States Patent [19]

Wright

[11] 4,047,557

[45] Sept. 13, 1977

[54] ELECTROSLAG REMELTING APPARATUS FOR REBUILDING GROUSER BARS

[76] Inventor: James H. Wright, 1211 Wright Ave., Richmond, Calif. 94808

[21] Appl. No.: 691,900

[22] Filed: June 1, 1976

[51] Int. Cl.[2] ..... B22D 19/10; B22D 27/02

[52] U.S. Cl. ..... 164/252; 164/334; 249/94; 164/92

[58] Field of Search ..... 164/52, 92, 252, 98, 164/334; 249/83, 93, 94, 95, 97

[56] References Cited

U.S. PATENT DOCUMENTS

| | | | |
|---|---|---|---|
| 3,563,614 | 2/1971 | Parks | 305/54 |
| 3,894,574 | 7/1975 | Paton et al. | 164/52 |
| 3,978,907 | 9/1976 | Rabinovich et al. | 164/52 |

*Primary Examiner*—Robert D. Baldwin
*Attorney, Agent, or Firm*—Harris Zimmerman

[57] ABSTRACT

A mold and process for rebuilding grouser bars includes an upwardly disposed mold base member having a centrally disposed spine extending the length thereof. A pair of upwardly disposed mold side members abut the spine of the base member to form a mold cavity having the configuration of a grouser bar. A track plate is placed in abutment to the mold with the worn grouser bar extending into the mold cavity, and is clamped into such position. A consumable welding electrode is inserted through the top of the mold cavity, and the electroslag process is started. The mold is cooled by water jackets, so that the metal fuses to the worn grouser bar, rebuilding it to its original dimensions.

4 Claims, 7 Drawing Figures

ELECTROSLAG REMELTING APPARATUS FOR REBUILDING GROUSER BARS

BACKGROUND OF THE INVENTION

Track-laying vehicles such as tractors, weapons carriers, and personnel carriers, snow vehicles and the like ride on tracks composed of multiple track plates. Each track plate includes a terrain gripping lug known in the art as a grouser bar. Grouser bars are an integral part of the track plate, and are subject to the most wear of any portion of the plate. As the grouser bars are worn away, and in particular the corners of the bar are eroded, they must be rebuilt or replaced. As the track plates represent large mass of tough steel, it is advantageous to rebuld the grouser bars rather than replace the entire plate.

It is known in the prior art to rebuild a grouser bar by various methods. These include welding shoes onto the worn surface, cutting off the worn grouser bar and welding on a complete new one, of adding metal to the worn surface by repeated passes of a welder using a consumable electrode. None of these methods are satisfactory.

Welding shoes onto the worn surface is a difficult process, since it involves securing shoes which have the proper dimensions to rebuild the worn bar to its original dimensions. Also, the weld seam is a stress concentration point, and a likely spot for structural failure. Cutting off the worn bar involves wasting the mass of the bar which remains, and also requires a great deal of time in the welding process and in the refitting process. Here again, the weld seam is a likely area for structural failure. Further, it is difficult to weld hard, long-wearing alloy material with any ductility.

Rebuilding the grouser bar through repeated welding passes is a tedious job, even for a skilled welder. Carelessness will result in voids or other faults in the added material, and in any event the added metal must be ground down to the desired finished size. The labor involved in this process is very costly.

SUMMARY OF THE INVENTION

The present invention generally comprises a mold and method for rebuilding grouser bars easily and quickly, yet with superior structural strength. It includes a water-cooled mold with an interior cavity having the configuration of a new grouser bar. The mold is open on one side to receive the worn grouser bar, and the track plate thereof is clamped over the open side in sealing fashion. Welding flux is placed in the cavity, and a consumable welding electrode is inserted through an open end of the mold. The electrode and flux, heated in accordance with the electroslag consumable electrode technique, form a molten mass of metal which fills the gap between the surface of the worn bar and the interior of the cavity.

As the mass cools, it fuses with the worn bar and not to the mold, due to the cooling jacket thereon. In this manner the grouser bar is rebuilt to its original dimensions, regardless of the amount or nature of the wear. The rebuilt portion is fused with the original bar so that no stress lines from weld seams can cause structural failure. After the bar has cooled it may be removed from the mold, and any flash or other imperfections removed. Very little finishing work is required, compared to former methods, since the mold provides smooth sides and a continuous junction with the existing grouser bar. The rebuilt portion is 100% alloyed hard material, which results in a longer wearing bar. The method of the present invention is completely automatic, and therefore much faster than previous rebuilding methods.

THE DRAWING

DESCRIPTION OF THE PREFERRED EMBODIMENT

Figure 1:
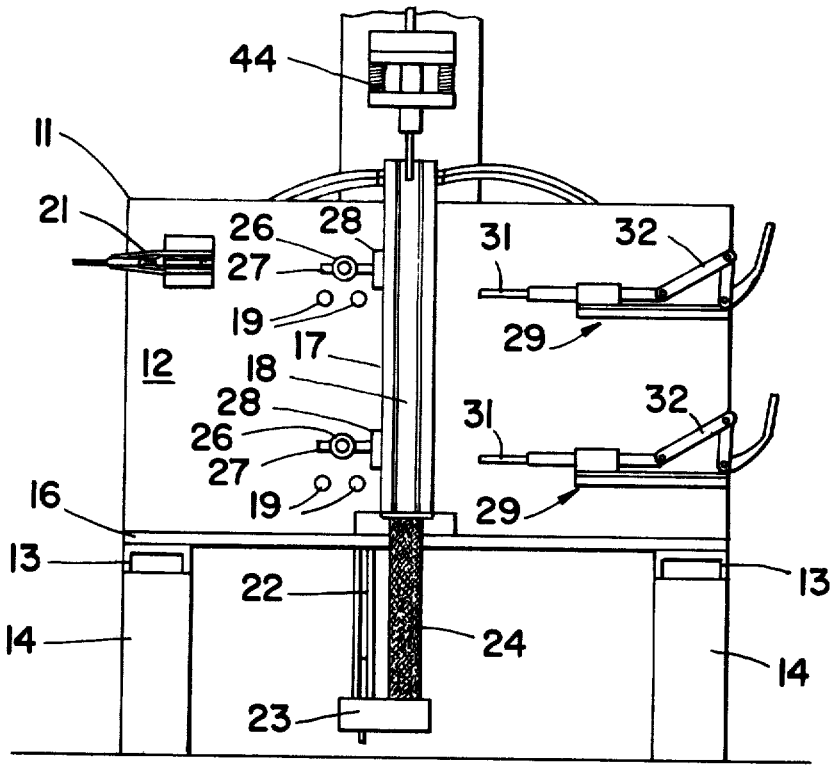
FIG. 1 is a front elevation of the molding apparatus of the present invention.
Figure 2:
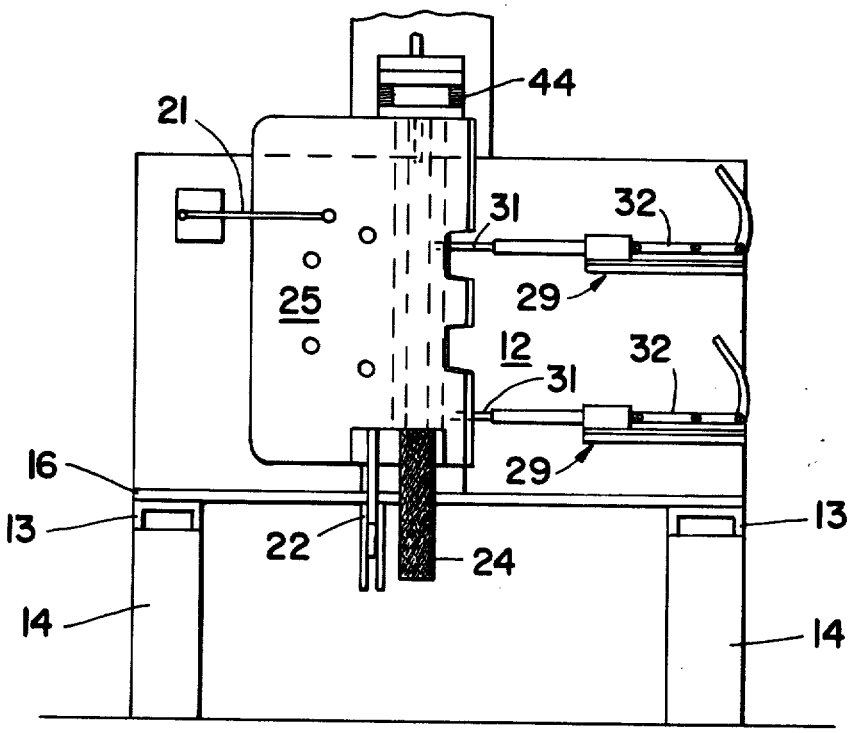
FIG. 2 is a front elevation of the molding apparatus of the present invention, shown with a track plate clamped thereto in position to rebuild a grouser bar.
Figure 3:
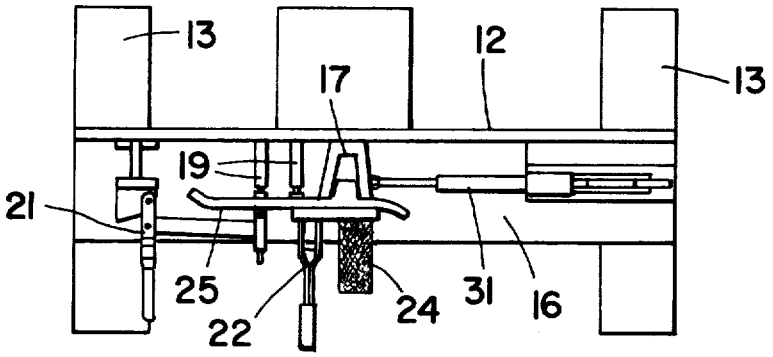
FIG. 3 is a top elevation of the molding apparatus of the present invention, shown with a grouser bar clamped into the mold cavity thereof.
Figure 4:
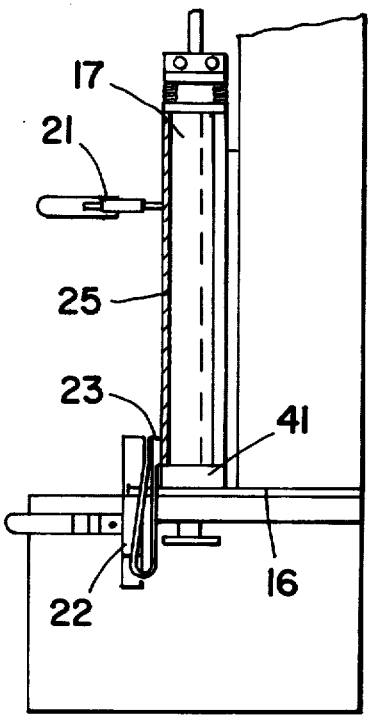
FIG. 4 is a side cross-sectional elevation of the present invention as shown in FIG. 3.
Figure 7:
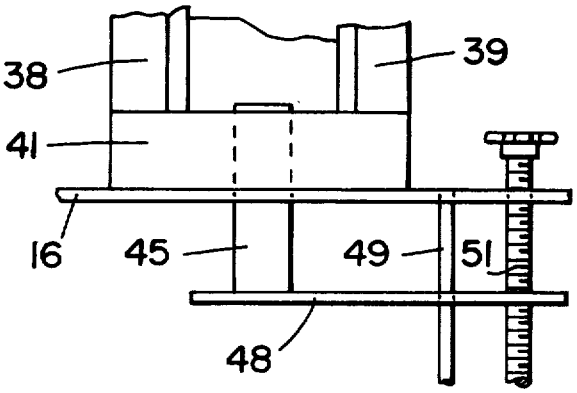
FIG. 7 is a detail view of the carbon rod advancement device of the present invention.

As shown in FIGS. 1, 3, and 4, the mold apparatus of the present invention generally includes a work stand 11 having a vertically extending wall 12 supported on horizontal members 13. The horizontal members are supported by legs 14, with a shelf 16 extending outwardly from the lower edge of the wall 12. Secured to a central portion of the wall 12 is a mold 17 for rebuilding grouser bars, the mold extending generally vertically and having a vertical cavity 18 opening outwardly with respect to the wall 12.

The mold cavity 18 has an interior configuration equal to the outer shape of a new grouser bar, and is adapted to receive a worn grouser bar therein for the purpose of rebuilding it to its original dimensions. Extending horizontally from the wall 12 and disposed adjacent to the mold are a plurality of tubular supports 19 which terminate at their distal ends in the same vertical plane. An over-center clamping mechanism 21, well known in the art, is secured to the wall 12 and spaced from the supports 19. The clamping mechanism is adapted to clamp the track plate 25 of a grouser bar 35, to one pair of the tubular supports 19 while the bar is undergoing the rebuilding process.

A second clamping mechanism 22, similar to the first, is provided, secured to the lower surface of the shelf 16 directly below the bottom of the mold. The dog of this clamping mechanism is provided with a contact block 23 which is adapted to impinge on the track plate and form an electrical connection therewith. The contact block is connected through a ground strap 24 to the mold itself. Thus the clamping mechanism 22 serves both to complete the electrical welding circuit and to secure the lower end of the track plate over the open side of the mold in sealing fashion by clamping the track plate 25 to the other pair of supports 19.

Extending horizontally from the wall 12 adjacent to the mold are a pair of pipe members 26. Each pipe member includes a bar 27 extending laterally therefrom and impinging on a block 28 secured to the side of the mold. These bar and pipe member assemblies provide lateral support for the mold. Secured to the wall on the opposite side of the mold from the pipe members and aligned therewith are a pair of driving assemblies 29. Each of the assemblies 29 includes a laterally translatable rod 31 actuated by a handle and lever mechanism 32 to translate the rod toward the mold and apply considerable pressure to the side of the mold. The pipe members provide lateral support for the mold, so that the force applied by the rods 31 serves to squeeze the sides of the mold together about the worn grouser bar.

Figure 5:
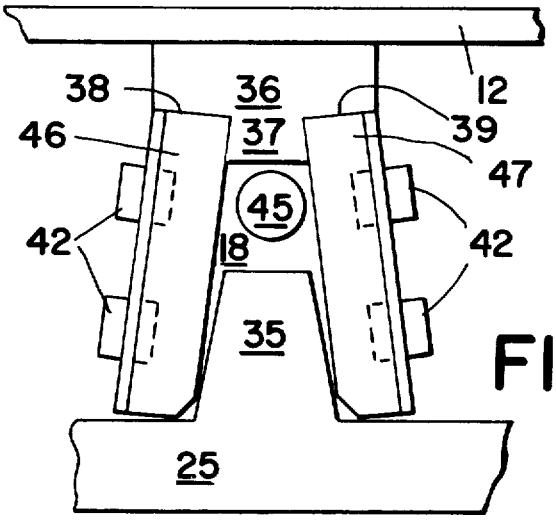
FIG. 5 is a top view of the mold portion of the present invention, shown with a worn grouser bar clamped therein.
Figure 6:
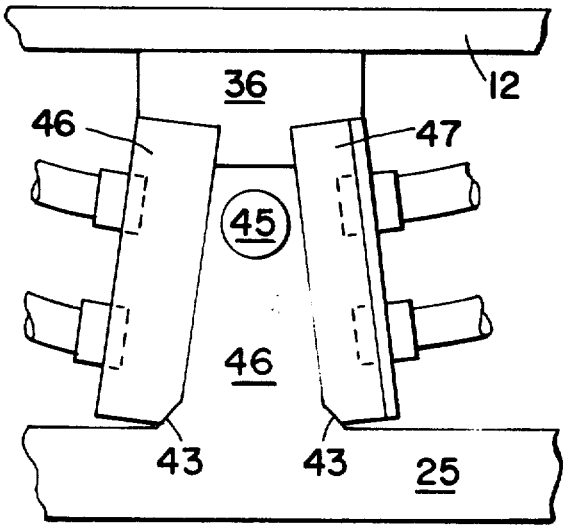
FIG. 6 is a top view as in FIG. 5, with a completed, rebuilt grouser bar disposed therein.

With reference to FIG. 5, the mold 17 includes a hollow mold base member 36 extending vertically along the wall 12. It includes a centrally disposed, longitudinally extending spine 37 which is provided with a wedge shape cross-section. The surfaces 38 and 39 extending from the spine to the sides of the member 36 are inclined slightly obliquely with respect to the wall 12. A pair of mold side members 46 and 47 are also provided, each comprising a rectangular hollow member dimensioned to be received in the vertex formed by the spine and the surfaces 38 or 39. A hollow bottom plate 41 closes the bottom of the mold, while the top and front are open. The base, side, and bottom members are hollow to permit cooling water from fixtures 42 to flow therethrough. The distal edges of the side members are bevelled (43) to provide a stress-relieving fillet at the juncture of the grouser bar and the track plate.

Extending through the bottom plate 41 is a carbon rod 45 which is supported on a plate 48. A screw jack 51 extends from the shelf 16 through the plate 48 for adjusting the spacing of the plate from the shelf and for adjusting the length of the carbon rod 45 extending into the mold. An alignment rod 49 extends from the shelf through the plate 48 to maintain the assembly in proper alignment. The arc which initiates the electroslag process is struck on the rod 45, so that the bottom plate 41 of the mold is not eroded after repeated use by the arc. As the rod 45 is eroded by the arc after multiple use, the screw jack is advanced to present the upper end of the rod 45 approximately flush with the surface of the bottom plate 41.

To employ the molding apparatus of the present invention shown in FIG. 1, a track plate 25 bearing a worn grouser bar 35 is disposed with the grouser bar placed within the cavity 18 of the mold. The clamping mechanisms 21 and 22 are then used to secure the track plate in that position and to ground the track plate. The sides of the mold are secured about the worn bar by the driving assemblies, the apparatus thus being disposed as shown in FIGS. 2–5.

Flux is then placed in the mold cavity, and a consumable welding electrode is lowered into the cavity while being supported by a rod feeding mechanism 44 disposed directly above the mold. Welding of the electroslag consumable electrode type is then commenced to fill the gap in the cavity between the surface of the worn grouser bar and the inner surface of the cavity with molten metal. The molten mass fuses with the worn bar, but not to the mold, which is cooled by the water flow in the interior thereof. After the current is turned off, the metal cools to form a rebuilt grouser 46 which has the exact dimensions of the original bar.

It should be emphasized that the grouser bar thus rebuilt has no welding seam to cause stress concentrations and structural failure, and requires little or no grinding or preparation before use. Further, it is noted that the actual configuration of the mold is determined by the original configuration of the grouser bar, and may vary from that disclosed herein.

I claim:

1. Apparatus for rebuilding worn grouser bars, including a support structure, a mold secured to said support structure, said mold having a cavity with the configuration of the outer surface of the original grouser bar and an outward opening, clamp means for securing a track plate to said support structure with said worn grouser bar disposed within said opening and extending into said cavity, consumable electrode welding means for filling the gap in said cavity between the surface of said grouser bar and the mold interior surface with molten electroslag metal; said mold including a base member secured to said support structure, a pair of opposed side members defining the laterally extending sides of the rebuilt grouser bar, and an end plate defining the lateral working end of said grouser bar, said side members and said end plate being secured to said base member.

2. The apparatus of claim 1, further including means for urging said side members inwardly toward said worn grouser bar.

3. The apparatus of claim 1, wherein said mold members include cooling jackets for retaining circulating cooling fluid.

4. The apparatus of claim 1, wherein said mold base member includes a spine extending longitudinally therefrom, said side members impinging on opposed sides of said spine and being spaced apart thereby.

* * * * *